US008740730B1

(12) United States Patent
Przyborowski

(10) Patent No.: US 8,740,730 B1
(45) Date of Patent: Jun. 3, 2014

(54) FOOTBALL THROWING TEACHING ASSEMBLY

(76) Inventor: Peter Przyborowski, New Fairfield, CT (US)

( * ) Notice: Subject to any disclaimer, the term of this patent is extended or adjusted under 35 U.S.C. 154(b) by 349 days.

(21) Appl. No.: 13/162,323

(22) Filed: Jun. 16, 2011

(51) Int. Cl.
*A63B 21/065* (2006.01)

(52) U.S. Cl.
USPC ..... 473/438

(58) Field of Classification Search
USPC ..... 473/438
See application file for complete search history.

(56) References Cited

U.S. PATENT DOCUMENTS

| | | | | |
|---|---|---|---|---|
| 1,591,523 | A | 7/1926 | Fuller | |
| 4,383,685 | A * | 5/1983 | Bishop | 473/450 |
| 4,836,195 | A | 6/1989 | Berrehail | |
| 4,984,789 | A | 1/1991 | Socci | |
| 5,222,733 | A | 6/1993 | Brunty | |
| 6,645,093 | B2 | 11/2003 | Sheppard | |
| 7,074,139 | B2 | 7/2006 | Vogel | |
| 7,374,523 | B2 * | 5/2008 | Weir et al. | 482/148 |
| D598,116 | S | 8/2009 | Vollbrecht | |

* cited by examiner

*Primary Examiner* — Gene Kim
*Assistant Examiner* — Amir Klayman

(57) ABSTRACT

A football throwing teaching assembly includes a harness with a back wall, a first lateral wall and a second lateral wall. Shoulder straps extend between and are attached to the first and second lateral walls and the back wall. A panel is attached to the back wall adjacent to its upper edge and extends rearwardly and laterally away from the back wall. The panel has a front edge and an outer edge with respect to the back wall. A forward section is attached to the panel at a juncture of the front edge and the outer edge and extends forward with respect to the back wall. An arm receiving space is defined between the first lateral wall and the forward section. The arm receiving space receives an arm of a person to inhibit the person from lowering their elbow below their shoulder while throwing a football.

7 Claims, 4 Drawing Sheets

FOOTBALL THROWING TEACHING ASSEMBLY

BACKGROUND OF THE DISCLOSURE

Field of the Disclosure

The disclosure relates to football throwing technique improving devices and more particularly pertains to a new football throwing technique improving device for training a person the proper mechanical form when throwing a football.

SUMMARY OF THE DISCLOSURE

An embodiment of the disclosure meets the needs presented above by generally comprising a harness that includes a back wall. A first lateral wall and a second lateral wall are each attached to the back wall. The first and second lateral walls each have a distal edge with respect to the back wall. The back wall is configured to be positioned against a person's back so that the lateral walls extend partially around a front side of the person. Shoulder straps extend between and are attached to the first and second lateral walls and the back wall. A panel is attached to the back wall adjacent to an upper edge of the back wall and extends rearwardly and laterally away from the back wall. The panel has a front edge facing forward of the rear wall and an outer edge positioned distal to the rear wall. A forward section is attached to the panel at a juncture of the front edge and the outer edge and extends forward with respect to the back wall. An arm receiving space is defined between the first lateral wall and the forward section. The arm receiving space is configured to allow the person to extend their arm through arm receiving space such that an elbow of the person is vertically above a plane of the panel. The panel is comprised of a rigid material and inhibits the person from lowering their elbow below their shoulder while throwing a football.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
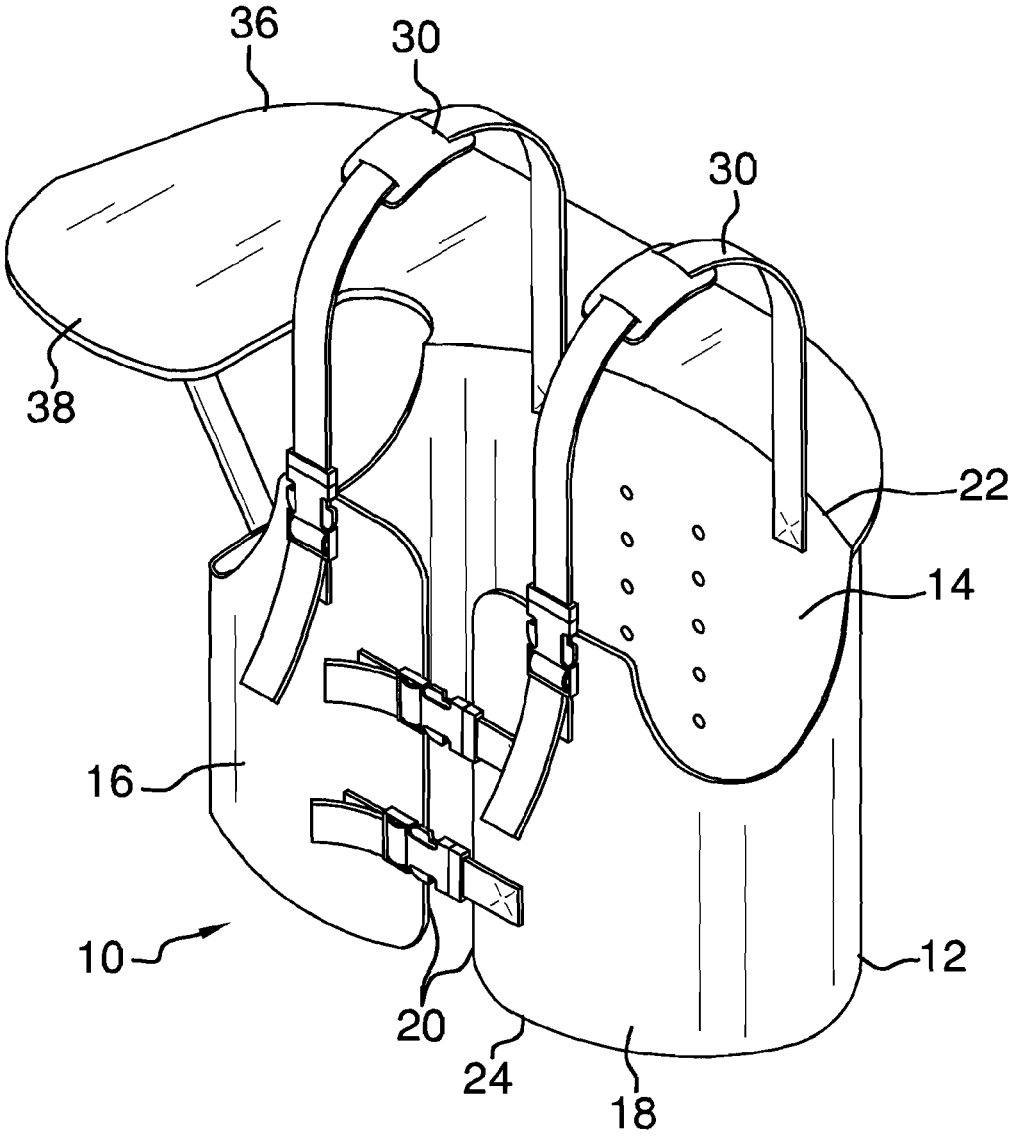
FIG. 1 is a top perspective view of a football throwing teaching assembly according to an embodiment of the disclosure.
Figure 2:
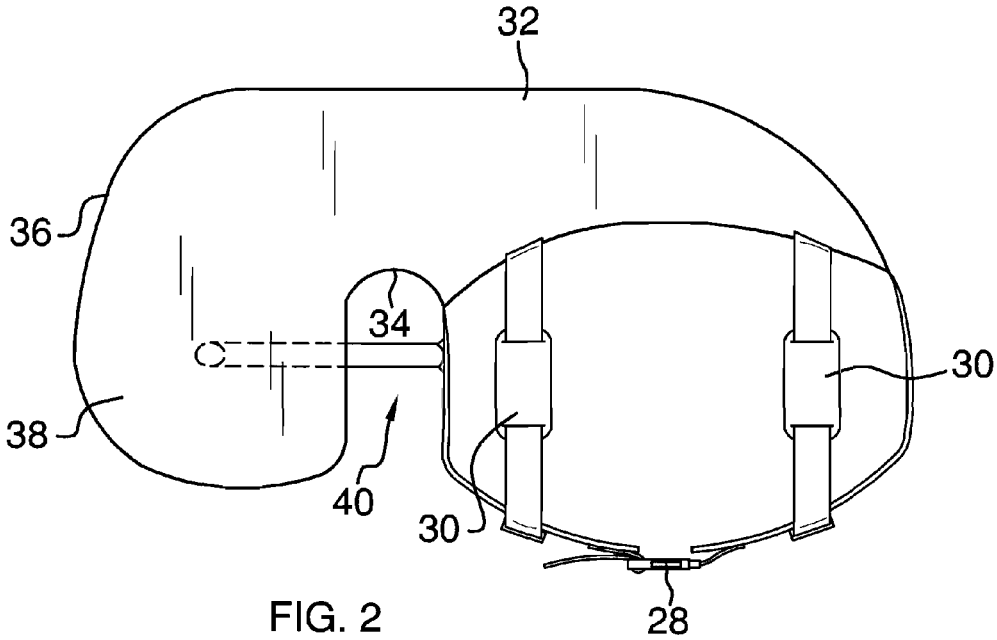
FIG. 2 is a top view of an embodiment of the disclosure.
Figure 3:
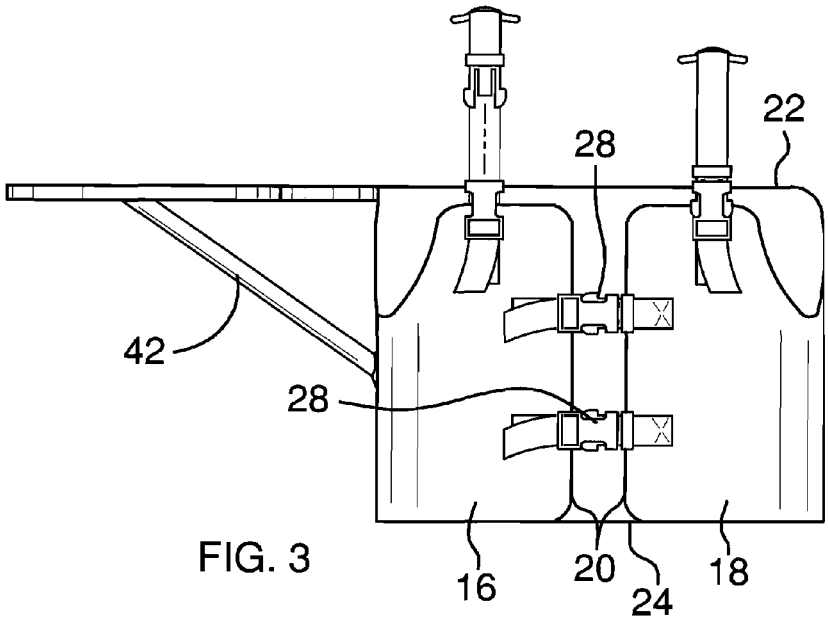
FIG. 3 is a front view of an embodiment of the disclosure.
Figure 4:
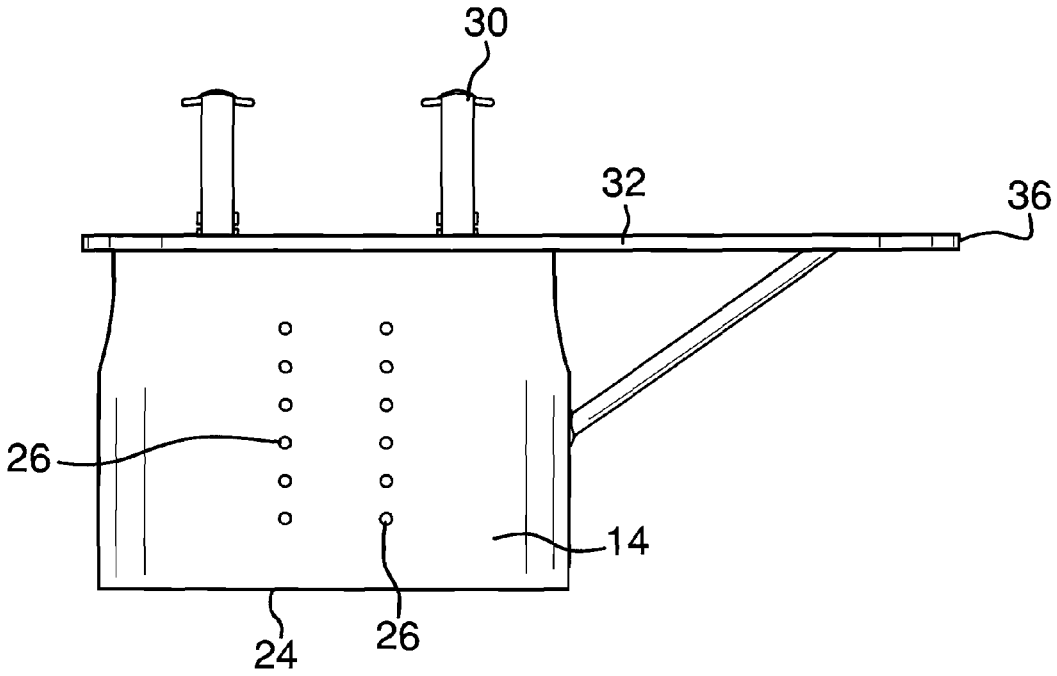
FIG. 4 is a rear view of an embodiment of the disclosure.
Figure 5:
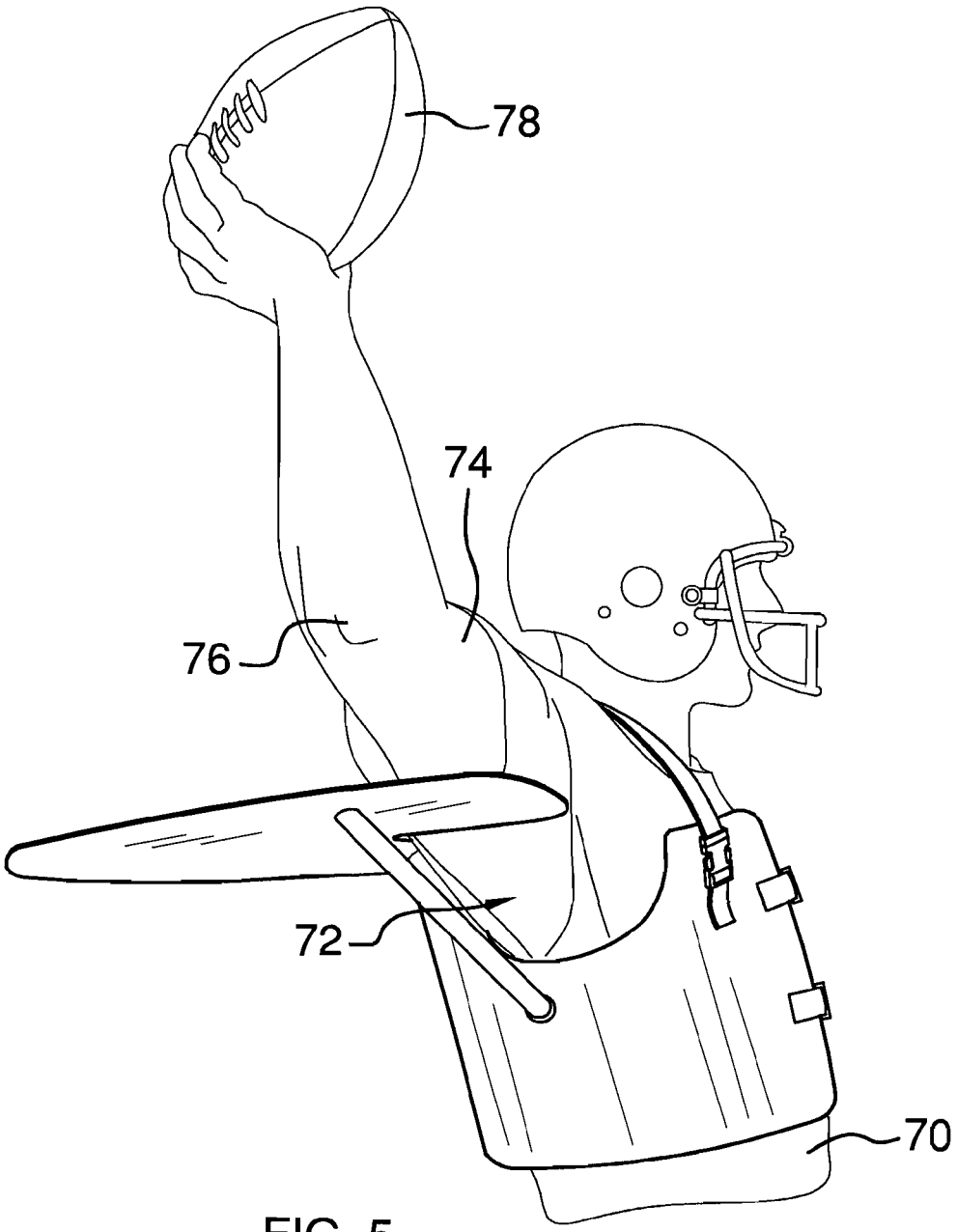
FIG. 5 is a perspective in-use view of an embodiment of the disclosure.

With reference now to the drawings, and in particular to FIGS. 1 through 5 thereof, a new football throwing technique improving device embodying the principles and concepts of an embodiment of the disclosure and generally designated by the reference numeral 10 will be described.

As best illustrated in FIGS. 1 through 5, the football throwing teaching assembly 10 generally comprises a harness 12 to be worn on a person's torso. The harness 12 includes a back wall 14. A first lateral wall 16 and a second lateral wall 18 are each attached to the back wall 14. Each of the first 16 and second 18 lateral walls has a distal edge 20 with respect to the back wall 14. The back wall 14 is configured to be positioned against the person's back so that the lateral walls 16, 18 extend partially around a front side of the person. The first 16 and second 18 lateral walls are resiliently flexible from the back wall 14 to the distal edges 20 to allow the harness 12 to contour around the sides of the person. The back wall 14 and the first 16 and second 18 lateral walls resist being bent along vertically orientated lines extending between an upper edge 22 of the back 14, first lateral 16 and second 18 lateral walls and a lower edge 24 of the back 14, first lateral 16 and second lateral 18 walls. The back wall 14 may have a plurality of air apertures 26 extending therethrough to allow air to flow through the back wall 14.

A coupler 28 releasably attaches the distal edges 20 of the first 16 and second 18 lateral walls together. As can be seen in FIG. 1, multiple couplers 28 may be used and each may be adjustable to alter a distance between the distal edges 20. A pair of shoulder straps 30 is provided. The first 16 and second 18 lateral walls each have one of the shoulder straps 30 attached thereto. Each of the shoulder straps 30 is attached to the back wall 14 adjacent to the upper edge 22 of the back wall 14. The shoulder straps 30 may have an adjustable length to adjust a distance between the upper edges 22 of the first 16 and second 18 lateral walls and the underarms 72, or axillae, of the person 70.

A panel 32 is attached to the back wall 14 adjacent to the upper edge 22. The panel 32 extends rearwardly and laterally away from the back wall 14. The panel 32 therefore will be extending laterally away from one of the first 16 or second 18 lateral walls as well, wherein the lateral wall which it extends from is determined by the person's left or right handedness as will be apparent below. The panel 32 has a front edge 34 facing forward of the rear wall 14 and an outer edge 36 positioned distal to the rear wall 14. A forward section 38 is integrally attached to the panel 32 at a juncture of the front edge 34 and the outer edge 36 and extends forward with respect to the back wall 14. The forward section 36 and the panel 32 may be comprised of a single piece of material. An arm receiving space 40 is defined between the first lateral wall 16 and the forward section 36. The arm receiving space 40 is configured to allow the person 70 to extend their arm 74 through arm receiving space 40 such that an elbow 76 of the person 70 is vertically above a plane of the panel 32 and more particularly positioned above the forward section 36. The panel 32 is comprised of a rigid material such that it remains generally horizontally orientated while it is being used. As can be seen particularly in FIG. 3, an auxiliary support 42 for further bracing the panel 32 with respect to the harness 12 may be attached to and extend between the panel 32 and the harness 12.

In use, the person 70 wears the harness 12 and extends their arm 74 through the arm receiving space 40. When the person throws a football 78, the person 70 is inhibited from lowering their elbow 76 below their shoulder, except when the arm 74 follows all the way through forward of the shoulder. This will train the player 70 the proper mechanics of throwing a football 78.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A wearable assembly configured to instruct a proper throwing technique for throwing a football, said assembly including:

a harness including a back wall, a first lateral wall and a second lateral wall each being attached to said back wall, each of said first and second lateral walls having a distal edge with respect to said back wall, said back wall being configured to be positioned against a person's back such that said lateral walls extend partially around a front side of the person;

a pair of shoulder straps, said first and second lateral walls each having one of said shoulder straps attached thereto, each of said shoulder straps being attached to said back wall;

a panel being attached to said back wall adjacent to an upper edge of said back wall, said panel extending rearwardly and laterally away from said back wall, said panel having a front edge facing forward of said back wall and an outer edge positioned distal to said back wall, a forward section being attached to said panel at a juncture of said front edge and said outer edge and extending forward with respect to said back wall, an arm receiving space being defined between said first lateral wall and said forward section, said arm receiving space being configured to allow the person to extend their arm through arm receiving space such that an elbow of the person is vertically above a plane of said panel;

said panel being comprised of a rigid material; and wherein the person is inhibited from lowering their elbow below their shoulder while throwing a football.

2. The assembly according to claim 1, wherein said first and second lateral walls are resiliently flexible from said back wall to said distal edges, said back wall and said first and second lateral walls each resisting being bent along vertically orientated lines extending between an upper edge of said back, first lateral and second lateral walls and a lower edge of said back, first lateral and second lateral walls.

3. The assembly according to claim 1, further including a coupler releasably attaching said distal edges of said first and second lateral walls together.

4. The assembly according to claim 1, wherein said back wall has a plurality of air apertures extending therethrough.

5. A wearable assembly configured to instruct a proper throwing technique for throwing a football, said assembly including:

a harness including a back wall, a first lateral wall and a second lateral wall each being attached to said back wall, each of said first and second lateral walls having a distal edge with respect to said back wall, said back wall being configured to be positioned against a person's back such that said lateral walls extend partially around a front side of the person, said first and second lateral walls being resiliently flexible from said back wall to said distal edges, said back wall and said first and second lateral walls resisting being bent along vertically orientated lines extending between an upper edge of said back, first lateral and second lateral walls and a lower edge of said back, first lateral and second lateral walls;

a coupler releasably attaching said distal edges of said first and second lateral walls together;

a pair of shoulder straps, said first and second lateral walls each having one of said shoulder straps attached thereto, each of said shoulder straps being attached to said back wall adjacent to said upper edge of said back wall, each of said shoulder straps having an adjustable length;

a panel being attached to said back wall adjacent to said upper edge, said panel extending rearwardly and laterally away from said back wall, said panel having a front edge facing forward of said back wall and an outer edge positioned distal to said back wall, a forward section being attached to said panel at a juncture of said front edge and said outer edge and extending forward with respect to said back wall, an arm receiving space being defined between said first lateral wall and said forward section, said arm receiving space being configured to allow the person to extend their arm through arm receiving space such that an elbow of the person is vertically above a plane of said panel;

said panel being comprised of a rigid material;

said back wall having a plurality of air apertures extending therethrough; and wherein the person is inhibited from lowering their elbow below their shoulder while throwing a football.

6. The assembly according to claim 5, wherein said panel is generally oriented horizontally when said harness is vertically oriented.

7. The assembly according to claim 1, wherein said panel is generally oriented horizontally when said harness is vertically oriented.

* * * * *